US007860220B2

(12) United States Patent
Aoyama et al.

(10) Patent No.: US 7,860,220 B2
(45) Date of Patent: Dec. 28, 2010

(54) MOLYBDENUM ALLOY; AND X-RAY TUBE ROTARY ANODE TARGET, X-RAY TUBE AND MELTING CRUCIBLE USING THE SAME

(75) Inventors: Hitoshi Aoyama, Imaharu (JP); Shinichi Yamamoto, Fujisawa (JP)

(73) Assignees: Kabushiki Kaisha Toshiba, Minato-Ku (JP); Toshiba Materials Co., Ltd., Isogo-Ku, Yokohama-Shi (JP)

( * ) Notice: Subject to any disclaimer, the term of this patent is extended or adjusted under 35 U.S.C. 154(b) by 14 days.

(21) Appl. No.: 12/091,537

(22) PCT Filed: Oct. 27, 2006

(86) PCT No.: PCT/JP2006/321544

§ 371 (c)(1),
(2), (4) Date: Jun. 26, 2008

(87) PCT Pub. No.: WO2007/049761

PCT Pub. Date: May 3, 2007

(65) Prior Publication Data

US 2009/0290685 A1 Nov. 26, 2009

(30) Foreign Application Priority Data

Oct. 27, 2005 (JP) ..... 2005-313268

(51) Int. Cl.
*H01J 35/10* (2006.01)
*H01J 35/08* (2006.01)

(52) U.S. Cl. ..... 378/144; 378/143

(58) Field of Classification Search ..... 378/143, 378/144; 420/429, 591; 148/407, 423, 429, 148/538

See application file for complete search history.

(56) References Cited

U.S. PATENT DOCUMENTS 4,165,982 A * 8/1979 Tatsuo et al. ..... 420/429
4,622,688 A * 11/1986 Diemer et al. ..... 378/143

(Continued)

FOREIGN PATENT DOCUMENTS

JP 04-305023 10/1992

(Continued)

OTHER PUBLICATIONS

Khan, A.A., et al., "Molybdenum and tungsten coatings for x-ray targets obtained through the low-pressure plasma spraying process", Jun. 1997, Journal of Thermal Spray Technology, vol. 6, No. 2., pp. 228-234.*

(Continued)

*Primary Examiner*—Edward J Glick
*Assistant Examiner*—Anastasia Midkiff
(74) *Attorney, Agent, or Firm*—Burr & Brown

(57) ABSTRACT

This invention provides a molybdenum alloy having excellent high-temperature strength, an X-ray tube rotary anode target having high-temperature strength, an X-ray tube, and a melting crucible. The molybdenum alloy, having an oxygen content of not more than 50 ppm, comprising 0.2 to 1.5% of a carbide by weight and the balance, molybdenum, wherein the carbide is at least one selected from titanium carbide, hafnium carbide, zirconium carbide, and tantalum carbide, and a part of the carbides has an aspect ratio of not less than 2.

8 Claims, 3 Drawing Sheets

25 μm

U.S. PATENT DOCUMENTS

| | | | | | |
|---|---|---|---|---|---|
| 4,717,538 | A | * | 1/1988 | Patrician et al. | 420/429 |
| 4,876,705 | A | * | 10/1989 | Delair et al. | 378/144 |
| 4,953,190 | A | * | 8/1990 | Kukoleck et al. | 378/129 |
| 5,222,116 | A | * | 6/1993 | Eloff et al. | 378/143 |
| 5,693,156 | A | * | 12/1997 | Berczik | 148/407 |
| 6,157,702 | A | * | 12/2000 | Reznikov et al. | 378/144 |
| 2009/0103684 | A1 | * | 4/2009 | Vetter | 378/144 |

FOREIGN PATENT DOCUMENTS

| | | |
|---|---|---|
| JP | 06-256097 | 9/1994 |
| JP | 11-264045 | 9/1999 |
| JP | 2001-279362 | 10/2001 |
| JP | 2002-170510 | 6/2002 |

OTHER PUBLICATIONS

Suzuki et al., "Mo-ZrC in-situ Kyosho Fukugo Zairyo no Koon Kyodo to Hakai Jinsei", Materia Japan, Mar. 20, 2003, vol. 41, No. 3, p. 150-153.

Aoyama et al., "Ekiso Shoketsu shita Teisanso TiC-ZrC-Mo Tanzotai no Kessho Soshiki, Koon Kyodo, Oyobi CO Gas Hoshutsu Tokusei", Journal of the Society of Materials Science, Japan, Jun. 15, 2006, vol. 55, No. 6, p. 558-562.

* cited by examiner

25 μm

MOLYBDENUM ALLOY; AND X-RAY TUBE ROTARY ANODE TARGET, X-RAY TUBE AND MELTING CRUCIBLE USING THE SAME

FIELD OF THE INVENTION

The present invention relates to a molybdenum alloy having excellent high-temperature strength. The present invention also relates to an X-ray tube rotary anode target having improved gas release properties and an X-ray tube using the target, and a melting crucible.

BACKGROUND OF THE INVENTION

A TZM alloy comprising 0.5% by weight of titanium (Ti), 0.07% by weight of zirconium (Zr), and 0.05% by weight of carbon with the balance consisting of molybdenum has hitherto been known as a molybdenum (Mo) alloy having improved high-temperature strength. In the TZM alloy, the melting point of molybdenum as the main component is high, and, thus, the TZM alloy has excellent high-temperature strength. The TZM alloy has been used in fields where high-temperature strength properties are required, for example, in X-ray tube rotary anode targets and melting crucibles for use in melting of metals and the like by taking advantage of this high-temperature strength property.

The use of the TZM alloy in X-ray rotary anode targets posed a problem that impurities in the alloy, such as oxygen, carbon, and hydrogen, are gasified and lower the degree of vacuum in the X-ray tube resulting in deteriorated properties of the X-ray tube. Likewise, melting crucibles using the TZM alloy also involve a problem that gas components emitted during melting disadvantageously contaminate the melt. For example, the TZM alloy has a problem that a gas component is evolved from the alloy in a service environment of a high temperature of, for example, 800° C. or above and 1200° C. or above.

In order to cope with the evolution of the gas component under such high-temperature conditions, for example, in Patent No. 3052240 (patent document 1) or Japanese Patent Laid-Open No. 279362/2001 (patent document 2), an attempt has been made to add titanium or zirconium as a carbide. Further, in patent documents 1 and 2, a method is adopted in which, after sintering of a molybdenum molded product containing the carbide added thereto in a hydrogen atmosphere, the sinter is then sintered in vacuo to reduce the carbon and oxygen contents of the molybdenum sinter. Japanese Patent Laid-Open No. 170510/2002 (patent document 3) discloses a molybdenum alloy in which a part of added titanium and zirconium has been brought to a composite oxide. All the molybdenum alloys disclosed in patent documents 1 to 3 have improved gas release properties and, thus, when used in the X-ray tube rotary anode target, emits no significant amount of gas components. Accordingly, X-ray tubes can be provided with a low rejection ratio.

Patent document 1: Patent No. 3052240

Patent document 2: Japanese Patent Laid-Open No. 279362/2001

Patent document 3: Japanese Patent Laid-Open No. 170510/2002

SUMMARY OF THE INVENTION

On the other hand, X-ray tubes are used in X-ray inspection apparatuses in various fields, for example, nondestructive inspection apparatuses such as medical CT inspection apparatuses and baggage inspection. In the X-ray tube, an electron beam is applied while rotating a rotary anode comprising a shaft (a rotary shaft) joined to a rotary anode target having an electron beam irradiation face at a high speed of about 6000 to 10000 rpm to detect X rays emitted from the electron beam irradiation face. In recent years, an increase in output and an increase in definition of the X-ray inspection apparatus have been desired. For example, an increase in size of the rotary anode target is considered effective for realizing increased output and enhanced definition. Conventional rotary anode targets have a diameter of about 40 to 100 mm. The size of the rotary anode target is increased to a diameter of not less than 100 mm. When the size of the rotary anode target is increased, in the step of assembling a rotary anode target, a large load is applied due to an increased weight of the target in the fixation of the target to the shaft.

The above conventional rotary anode target formed of a molybdenum alloy provides an X-ray tube which, even when exposed to an elevated temperature, evolves no significant amount of gas component and has good quality. When a larger load is applied in assembling with a shaft due to a further increased size (for example, a diameter of not less than 100 mm), a problem of breaking, cracking or the like occurs because of low hardness of the conventional target. Likewise, also for melting crucibles used for melting metals and the like, an increase in size has posed a problem of breaking, cracking or the like upon working. The above problems are attributable to low hardness of the conventional molybdenum alloy.

The present invention has been made with a view to solving the above problems of the prior art. The present invention has found a molybdenum alloy which, even when used in an X-ray tube rotary anode target having an increased size (for example, a diameter of not less than 100 mm), does not cause any problem such as cracking. This has led to the completion of the present invention.

The above problems can be solved by a molybdenum alloy having an oxygen content of not more than 50 ppm, comprising 0.2 to 1.5% of by weight a carbide and the balance, molybdenum, wherein the carbide is at least one selected from titanium carbide, hafnium carbide, zirconium carbide, and tantalum carbide, and a part of the carbides has an aspect ratio of not less than 2.

The aspect ratio is preferably not less than 3.5. The molybdenum alloy preferably has a hardness of more than 250 HV and less than 350 HV, because, when the hardness is not less than 350 HV, a problem of abrasion of cutting tools or the like, for example, in cutting.

The above molybdenum alloy is suitable for X-ray tube rotary anode targets.

The X-ray tube rotary anode target may have a structure comprising the above molybdenum alloy (first molybdenum alloy) and a second molybdenum alloy stacked on top of each other, wherein the second molybdenum alloy having an oxygen content of 200 to 2000 ppm and comprises a composite oxide comprising titanium and zirconium. The X-ray tube rotary anode target preferably has a large diameter of more than 100 mm. Further, the structure is preferably such that the first molybdenum alloy is used for the X-ray tube rotary anode target at its place to which a rotary shaft is joined.

Preferably, a metal or alloy layer formed of at least one selected from tungsten (W), molybdenum (Mo), niobium (Nb), tantalum (Ta), rhenium (Re), titanium (Ti), zirconium (Zr), and carbon (C) is provided on an electron beam irradiation face of the X-ray tube rotary anode target. Preferably, an oxide film is provided on the surface of the part other than the electron beam irradiation face. The X-ray tube rotary anode target is suitable for X-ray tubes.

The molybdenum alloy is also suitable for melting crucibles.

The molybdenum alloy of the present invention has excellent hardness. Accordingly, X-ray tube rotary anode targets using the molybdenum alloy according to the present invention, X-ray tubes using the X-ray tube rotary anode target, and melting crucibles using the molybdenum alloy are less likely to undergo breaking or cracking.

DETAILED DESCRIPTION OF THE INVENTION

Figure 1:
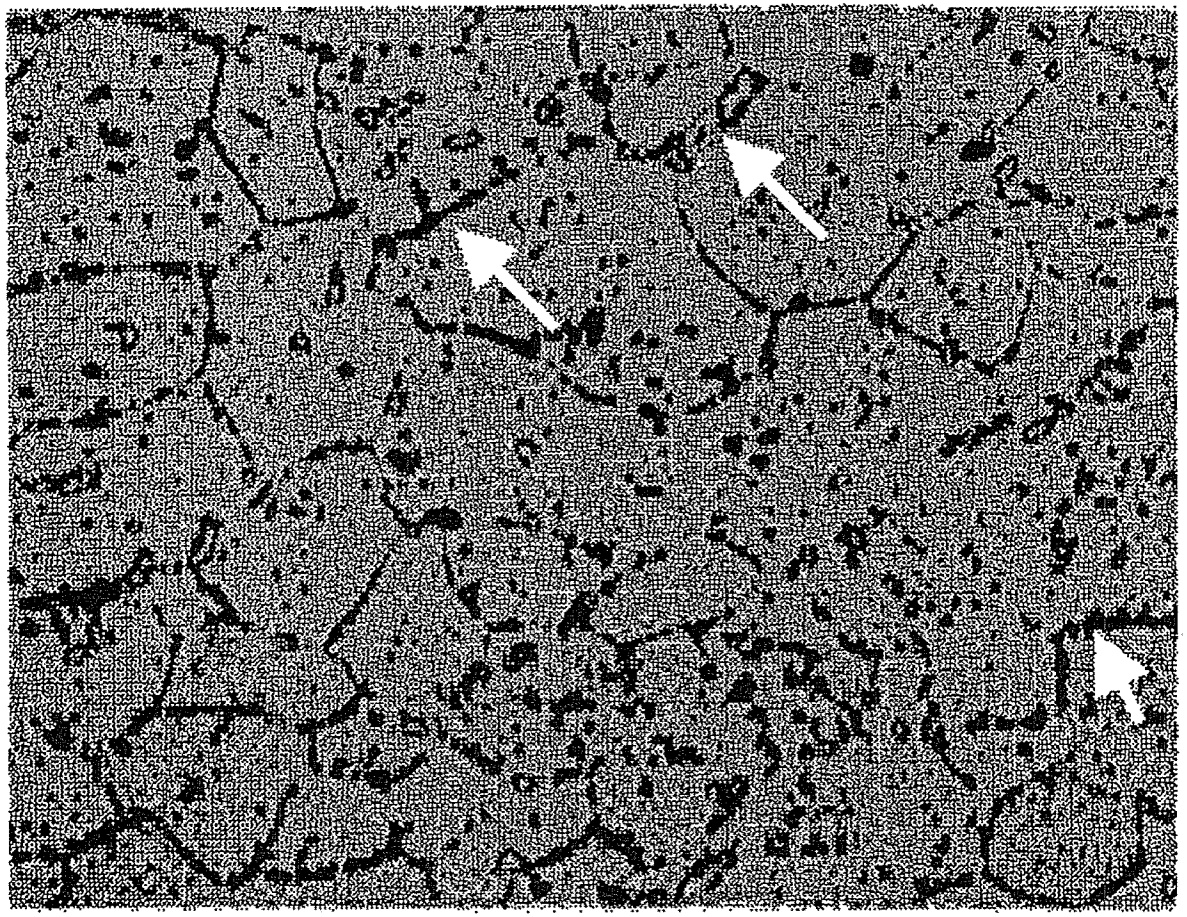
FIG. 1 is a diagram showing one embodiment of the microstructure of the molybdenum alloy according to the present invention.

The molybdenum alloy (first molybdenum alloy) according to the present invention is characterized by having an oxygen content of not more than 50 ppm and comprising 0.2 to 1.5% by weight of a carbide and the balance, molybdenum, wherein the carbide is at least one selected from titanium carbide, hafnium carbide, zirconium carbide, and tantalum carbide, and a part of the carbides has an aspect ratio of not less than 2.

At the outset, the molybdenum alloy according to the present invention is characterized by having an oxygen content of not more than 50 ppm. When the oxygen content exceeds 50 ppm, the amount of gas component emitted upon exposure of the molybdenum alloy to high temperature conditions is increased. The oxygen content preferably is not more than 30 ppm. The oxygen content refers to the content of oxygen in the molybdenum alloy. When an oxygen is present as an oxide in the molybdenum alloy, the oxygen content of the molybdenum alloy is a total oxygen content including the oxygen in the compound. The lower limit of the oxygen content is not particularly limited. The lower the oxygen content (a value below measurement limit), the smaller the amount of gas emitted under high temperature conditions and thus the better the results. However, the lower the oxygen content of the molybdenum alloy, the larger the degree of difficulty of producing the molybdenum alloy. For this reason, the oxygen content is generally not less than 5 ppm. The oxygen content is measured by an infrared absorption method.

The molybdenum alloy according to the present invention comprises 0.2 to 1.5% by weight of a carbide selected from titanium carbide (TiC), hafnium carbide (HfC), zirconium carbide (ZrC), and tantalum carbide (TaC) having an aspect ratio of 2 or more. When a plurality of carbides are contained, the total content of these carbides is 2 to 1.5% by weight. When carbide content is less than 0.2% by weight, the effect attained by the addition is small. On the other hand, when the carbide content exceeds 1.5% by weight, cracking is likely to occur during production steps such as forging. Further, in this case, the hardness exceeds 350 HV. The reason for this is believed to reside in that dispersion strengthening proceeds excessively.

FIG. 1 is a diagram showing one embodiment of the sectional structure of the molybdenum alloy according to the present invention. In the drawing, numeral 1 designates a molybdenum crystal grain, and numeral 2 designates a columnar carbide. In the present invention, the columnar carbide has an aspect ratio of 2 or more.

The present invention is characterized by containing a columnar carbide having an aspect ratio of 2 or more. The columnar carbide is present in a phase of grain boundaries between molybdenum crystal grains in the molybdenum alloy. When the columnar carbide is present in the grain boundary phase, the grain boundary phase is strengthened, contributing to improved strength. The aspect ratio is preferably not less than 3.5. When the aspect ratio is large and is not less than 3.5, the hardness can be improved. In the columnar carbide, a carbide having an aspect ratio of 2 or more may be previously added. However, bringing the aspect ratio to 2 or more, even 3.5 or more, by grain growth during sintering is preferred. In the columnar carbide formed by grain growth, the grains are grown in a columnar form along the grain boundary phase of molybdenum crystal grains. Accordingly, the hardness can be further improved.

The upper limit of the aspect ratio is not particularly limited. Preferably, however, the aspect ratio of 20 or less. When the aspect ratio is above the upper limit of the above-defined range, carbides collide with one another in a grain growth process. In this case, disadvantageously, unnecessary internal stress occurs.

In the present invention, all the carbides contained in the molybdenum alloy do not necessarily have an aspect ratio of 2 or more, and contemplated results can be obtained when at least 50% (in terms of number of carbides) of all the carbides contained in the molybdenum alloy is accounted for by carbides having an aspect ratio of 2 or more, even 3.5 or more. The aspect ratio may be determined by identifying and mapping the carbide in a large area element distribution by EPMA (spot diameter 100 μm, CuKα line) in a visual field at a magnification of 200 times, then measuring the major axis length X and minor axis length Y of the observed carbide grains, totalizing the measured values, and dividing the total value by the observed number of carbide grains to determine the average aspect ratio (X/Y).

This molybdenum alloy according to the present invention has a hardness of more than 250 HV and less than 350 HV. Further, an excellent tensile strength of not less than 400 MPa at 1000° C. can also be realized. That is, the molybdenum alloy according to the present invention has improved hardness while maintaining the tensile strength.

The molybdenum alloy having high hardness is suitable for members where mechanical hardness is required, for example, X-ray tube rotary anode targets and melting crucibles.

The X-ray tube rotary anode target may be formed of the molybdenum alloy (first molybdenum alloy) according to the present invention only. Alternatively, a laminate of the first molybdenum alloy and a second molybdenum alloy which will be described later may be adopted.

As described above, in the first molybdenum alloy, the columnar carbide is present along the grain boundary phase. The columnar carbide can easily come into contact with oxygen in the molybdenum alloy. When the molybdenum alloy is placed under high-temperature conditions in such a state that the columnar carbide is in contact with oxygen, a gas component is disadvantageously emitted as a result of a reaction, for example, $TiC+TiO_2 \rightarrow Ti+CO_2+CO$. In other words, the first molybdenum alloy has such a structure that the high-temperature strength is high while a gas component is likely to be emitted under high-temperature conditions. Accordingly, the adoption of a laminate of the first molybdenum alloy and the second molybdenum alloy which is less likely to emit a gas component, is effective.

The second molybdenum alloy has an oxygen content of 200 to 2000 ppm and substantially consists of titanium, zirconium and a composite oxide of titanium and zirconium, and molybdenum as the balance. The titanium and zirconium contents are preferably 0.1 to 1.5% by weight and 0.01 to 0.5% by weight, respectively. The content of titanium in the second molybdenum alloy is the total titanium content including titanium in the composite oxide, and the content of zirconium in the second molybdenum alloy is the total zirconium content including zirconium in the composite oxide. Titanium and zirconium not in the form of the composite oxide are present, in the molybdenum alloy, as at least one of a metal as a simple substance, a carbide, and an oxide (an oxide not in a composite form). The composite oxide composed of titanium and zirconium is thermally stable and thus is less likely to react with carbon (carbide) in the molybdenum alloy. Accordingly, the occurrence of a gas component under high-temperature conditions can be suppressed. One example of a molybdenum alloy having good gas release properties (suppressed gas release) is described in Japanese Patent Laid-Open No. 170510/2002 (patent document 3).

Figure 2:
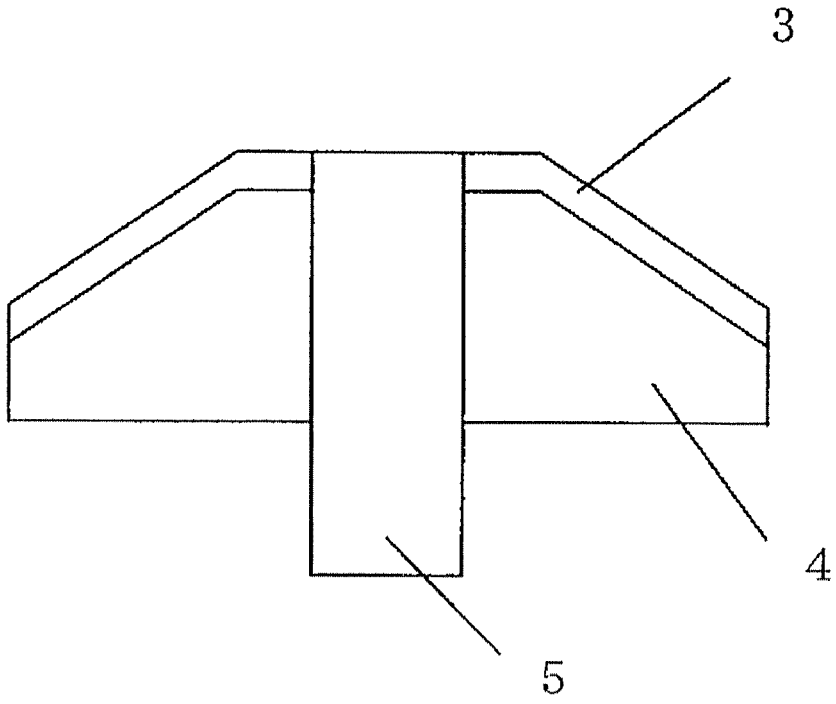
FIG. 2 is a diagram showing one embodiment of the X-ray tube rotary anode target according to the present invention.
Figure 3:
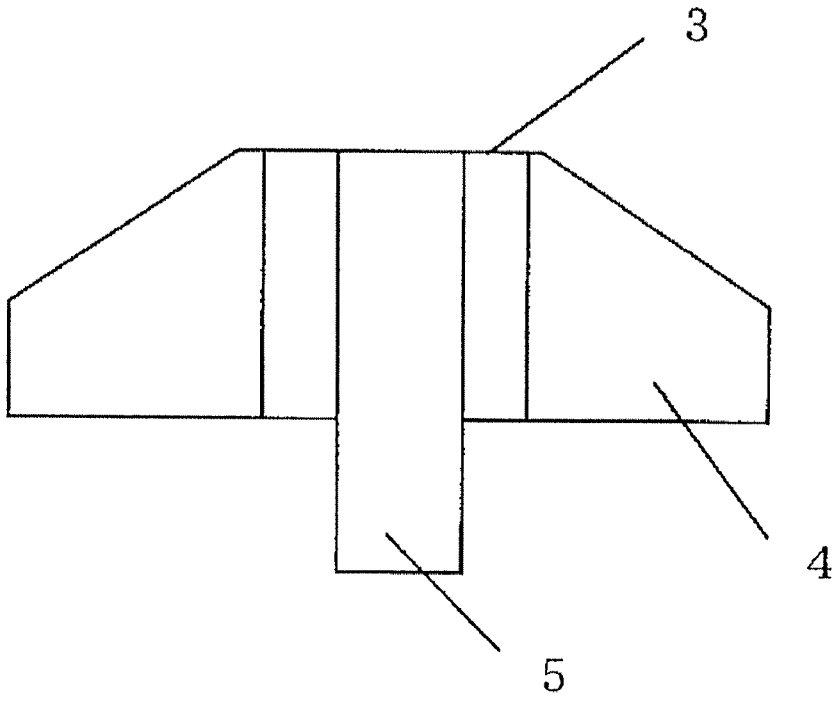
FIG. 3 is a diagram showing another embodiment of the X-ray tube rotary anode target according to the present invention.
Figure 4:
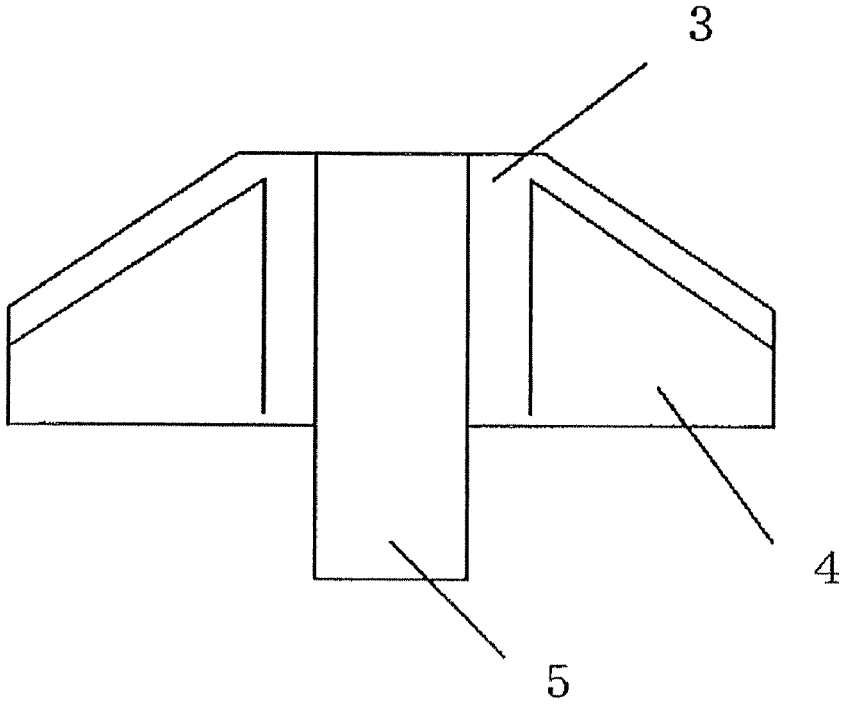
FIG. 4 is a diagram showing still another embodiment of the X-ray tube rotary anode target according to the present invention.

The first molybdenum alloy has high hardness, but on the other hand, the gas release properties are inferior to those of the second molybdenum alloy. On the other hand, the second molybdenum alloy has good gas release properties, but on the other hand, the hardness is lower than the hardness of the first molybdenum alloy. When an X-ray tube rotary anode target is produced by taking advantage of the properties of each molybdenum alloy, the adoption of a laminate structure in which the first molybdenum alloy having high hardness has been applied to a site jointed to a shaft (a rotary shaft) is preferred. One embodiment of the laminate structure is shown in FIGS. 2, 3 and 4. In the drawings, numeral 3 designate a first molybdenum alloy, numeral 4 a second molybdenum alloy, and numeral 5 a shaft. That is, an X-ray tube rotary anode target having high level of breaking resistance and cracking resistance can be produced by applying the first molybdenum alloy to a place which is likely to undergo a stress load.

When the X-ray tube rotary anode target has the above high hardness, a target having a diameter of more than 100 mm (even not less than 130 mm), which undergoes a large load, can also be realized.

Figure 5:
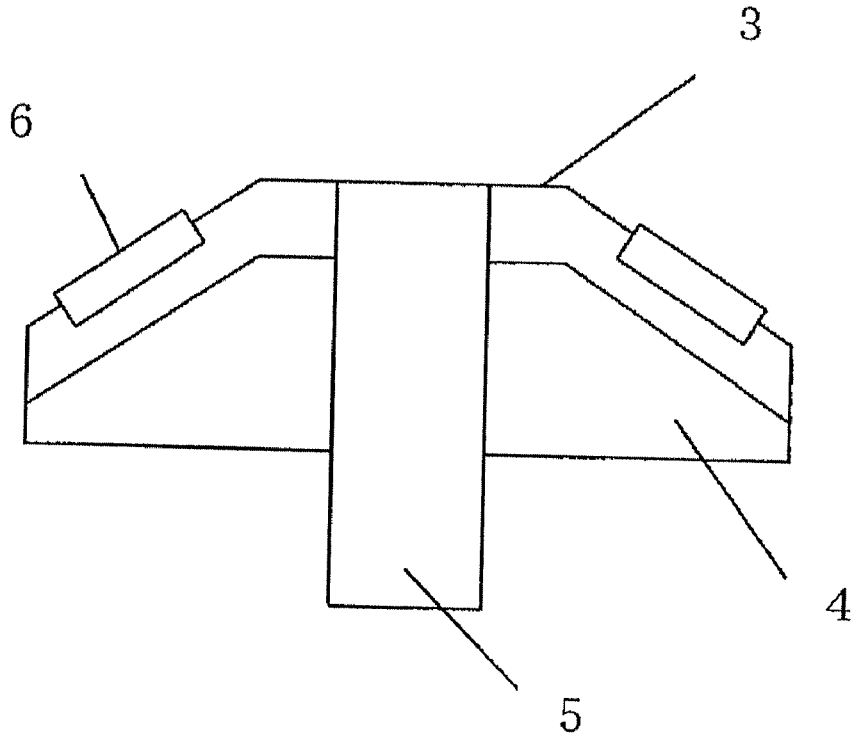
FIG. 5 is a diagram showing a further embodiment of the X-ray tube rotary anode target according to the present invention.

Further, in the X-ray tube rotary anode target, preferably, a metal or alloy layer formed of at least one metal selected from tungsten (W), molybdenum (Mo), niobium (Nb), tantalum (Ta), rhenium (Re), titanium (Ti), zirconium (Zr), and carbon (C) is provided on an electron beam irradiation face of the X-ray tube rotary anode target. In the X-ray tube rotary anode target, X-rays are produced by applying an electron beam to the electron beam irradiation face. In order to alleviate electron impact, the provision of a metal or alloy layer formed of at least one metal selected from tungsten, molybdenum, niobium, tantalum, rhenium, titanium, zirconium, and carbon is preferred. For example, a rhenium-tungsten alloy may be mentioned as the material for constituting the alloy layer. That is, the metal layer or alloy layer can function as an electron impact relaxation layer. FIG. 5 is a diagram showing one embodiment of an X-ray tube rotary anode target provided with an electron impact relaxation layer. In the drawing, numeral 6 designates an electron impact relaxation layer.

An oxide film is preferably provided on the surface of the X-ray tube rotary anode target in its part other than the electron beam irradiation face. The oxide film is preferably formed of $Al_2O_3$ (aluminum oxide), $TiO_2$ (titanium oxide), $ZrO_2$ (zirconium oxide), $SiO_2$ (silicon oxide), or a mixture thereof. The oxide film may have a single-layer structure or a multilayer structure. Methods usable for oxide film formation include thermal spraying, CVD, and PVD (vapor deposition or sputtering). The provision of the oxide film can reduce the amount of release of gas from the X-ray tube rotary anode target. As described above, the first molybdenum alloy is inferior in gas release properties to the second molybdenum alloy. The provision of an oxide film is effective for reducing the amount of release of gas.

X-ray tubes using the above X-ray tube rotary anode target is excellent in hardness, as well as in gas release properties. Accordingly, the X-ray tube rotary anode target can be applied to X-ray inspection apparatuses in various fields, for example, nondestructive inspection apparatuses such as medical CT inspection apparatuses and baggage inspection apparatuses. In particular, since the X-ray tube rotary anode target has improved hardness, it is suitable for large-size or high-output X-ray tubes.

Further, the molybdenum alloy according to the present invention, by virtue of its high hardness, is also suitable for melting crucibles for use in melting of metals and the like. In particular, even when the size of the crucible is large and is 100 mm or more in diameter (outer diameter), the crucible is less likely to be scratched by external force and thus has excellent durability.

Next, a process for producing the first molybdenum alloy will be described. The production process of the molybdenum alloy is not particularly limited. An example of a preferred production process will be described.

At the outset, a molybdenum powder and a carbide powder such as a TiC powder are provided as raw material powders, and they are mixed together, for example, in a ball mill. Preferably, the molybdenum powder has an average particle diameter of not more than 5 μm, and the carbide powder has an average particle diameter of not more than 2 μm. More preferably, the molybdenum powder and the carbide powder satisfy the following requirement: average particle diameter of molybdenum powder>average particle diameter of carbide powder. Still more preferably, a requirement of [average particle diameter of molybdenum powder>3 (average particle diameter of carbide powder)] is satisfied. When the average particle diameter of carbide powder is smaller than the average particle diameter of the molybdenum powder, the carbide can be easily and evenly dispersed in the grain boundary phase of molybdenum.

Next, the mixed raw material powder is molded in a mold at a pressure of not less than 200 MPa to produce a molded product. The molding pressure is preferably 200 to 500 MPa. When the molding pressure is less than 200 MPa, the density of the molded product is so low that the production of a high-density sinter is difficult. On the other hand, when the molding pressure exceeds 500 MPa, disadvantageously, the molded product is likely to be cracked.

Next, a sintering step is carried out. Preferably, in order to minimize the influence of oxygen, the sintering step is carried out in such a state that the molded product is placed in a carbon crucible. The sintering step is preferably carried out in a sintering atmosphere of an inert gas at a sintering temperature of 1900° C. or above. Inert gases include nitrogen, argon, and krypton. The sintering temperature is more preferably 2100° C. or above. The above sintering conditions are applicable to the second sintering step which will be described later.

When sintering is carried out in an inert atmosphere, there is no possibility that the molybdenum sinter (molybdenum molded product) is reacted with the inert gas during sintering. Accordingly, only unnecessary CO gas and $CO_2$ gas present in the sinter are released, and the carbide is not decomposed to an unnecessarily high level. Therefore, carbide grains are grown during sintering to an aspect ratio of not less than 2, even not less than 3.5. The sintering time is about 5 to 20 hr. When the sintering temperature is below 1900° C., the grain growth to a carbide having an aspect ratio of 2 or more is less likely to take place.

More preferred sintering conditions are as follows. The sintering step comprises a first sintering step of sintering the molded product in vacuo at 1500 to 1800° C. and a second sintering step of, after the first sintering step, sintering the molded product in an inert gas at 1900° C. or above.

The first sintering step is preferably carried out under conditions of a vacuum degree of not more than $10^{-3}$ Pa and a sintering time of about 1 to 10 hr. Sintering in vacuo (first sintering step) is advantageous because the carbide is not significantly decomposed during sintering. Conditions for the second sintering step are as described above. Thus, when a combination of the vacuum sintering (first sintering step) and the inert gas sintering (second sintering step) is adopted, the carbide is less likely to be decomposed and, at the same time, grain growth is facilitated, whereby the first molybdenum alloy according to the present invention can easily be produced. Preferably, the sintering atmosphere in the first sintering step and the sintering atmosphere in the second sintering step are identical, because maintaining the evacuated state at an elevated temperature causes a very high load on a commercial scale, leading to increased cost. Further, when sintering is carried out in a hydrogen atmosphere as in patent document 1, there is a possibility that the carbide is decomposed (decarburization by hydrogen takes place). This disadvantageously inhibits the grain growth of the carbide. Preferably, also in the first and second sintering steps, a carbon crucible is used.

Processes for producing an X-ray tube rotary anode target from a laminate of the first molybdenum alloy and the second molybdenum alloy include one which comprises placing raw material powders for a second molybdenum alloy in a mold, placing raw material powders for a first molybdenum alloy on the raw material powders for a second molybdenum alloy, molding the assembly, and sintering the molded product, one which comprises preparing a sinter of a first molybdenum alloy (or a sinter of a second molybdenum alloy), molding raw material powders for a second molybdenum alloy (or raw material powders for a first molybdenum alloy) and sintering the assembly, and one which comprising sintering a sinter of a first molybdenum alloy and a sinter of a second molybdenum alloy and integrating the sinter of a first molybdenum alloy with the sinter of a second molybdenum alloy by brazing or heating. The production process of the second molybdenum alloy is carried out as described in patent document 3 (Japanese Patent Laid-Open No. 170510/2002).

When sintering is carried out using a crucible or the like, near net production is preferred. Accordingly, the sinter as such may be used. If necessary, however, forging and rolling may be carried out. Upon forging or rolling, the structure of the molybdenum alloy is elongated in the forging or rolling direction, and, thus, the aspect ratio of the carbide can easily be brought to 2 or more, even 3.5 or more. In particular, in the forging and rolling, not less than 80% of the carbide in the alloy can easily be brought to a columnar carbide having an aspect ratio of 2 or more, even 3.5 or more.

When a metal layer or alloy layer of tungsten or the like is used in the electron irradiation face, simultaneous molding and sintering are possible. Alternatively, a method may be adopted in which, after the preparation of a molybdenum alloy sinter, integration is carried out. If necessary, an oxide film may be provided.

After the completion of an X-ray tube rotary anode target, degassing treatment may if necessary be carried out. The degassing treatment may be carried out under conditions of 1400 to 1800° C., not more than $10^{-3}$ Pa, and about 2 to 7 hr. After the completion of the preparation of the X-ray tube rotary anode target, an X-ray tube rotary anode to which a shaft has been joined is completed, followed by mounting on an X-ray tube to complete an X-ray assembly.

The same sintering method as described above can also be applied to the production of melting crucibles, and, if necessary, an oxide film may also be provided.

EXAMPLES

Example 1 and Comparative Example 1

A powder of at least one carbide selected from TiC, HfC, ZrC, and TaC having an average particle diameter of 1 μm was added, in an amount specified in Table 1, to and mixed with a molybdenum (Mo) powder having an average particle diameter of 4 μm in a ball mill. The mixture was molded in a mold at a pressure of 300 MPa to produce a molded product.

Next, the molded product was placed in a carbon crucible and was sintered in vacuo ($10^{-3}$ Pa) at 1500 to 1700° C. as a first sintering step. The sinter was subjected to a second sintering step at a temperature shown in Tables 1 to 4 in an inert atmosphere. The size of the shape of the sinter was rendered uniform and was 40ϕ in diameter×500 mm in length L. The sinter thus obtained was forged to 28 mmϕ. Thus, molybdenum alloys of Examples were produced.

Comparative Example

For comparison, molybdenum alloys were produced in the same manner as in the Examples, except that any carbon crucible was not used and sintering was carried out in an inert atmosphere or in vacuo ($10^{-3}$ Pa). In the table, the sintering was carried out in an inert atmosphere unless otherwise specified.

In the molybdenum alloy sinters of the Examples and the Comparative Examples, the content of oxygen in the alloys was measured. The oxygen content was measured by an infrared absorption method.

Further, for the axial direction (length), the cross-sectional microstructure was observed, and the aspect ratio of the carbide was determined. Specifically, in a visual field at a magnification of 200 times, the carbide was identified and mapped in a large area element distribution by EPMA (spot diameter 100 μm, CuKα line). Thereafter, the major axis length X and minor axis length Y of the observed carbide particles were measured. The measured values were totalized, and the total value was divided by the observed number of carbide particles to determine the average aspect ratio (X/Y).

Next, a test piece of 5.0ϕ×68 L was taken off from the central part of the 28 mmϕ material and was subjected to a tensile test in a vacuum atmosphere under conditions of heating rate 10° C./min, testing temperature 1000° C., holding time 5 min, and testing rate 2.5 mm/min to determine a high-temperature tensile strength.

Further, the Vickers hardness was determined by a method according to JIS Z 2244.

The results of the measurements are shown in Tables 1 to 4.

TABLE 1

| Sample | Composition, wt % | Sintering temperature, ° C. | Amount of oxygen, ppm | Aspect ratio of carbide | Hardness, HV | Tensile strength, MPa |
|---|---|---|---|---|---|---|
| 1 | TZM alloy (Commercially available product: Comparative material) | — | 210 | 1.5 | 230 | 400 |
| 2 | 0.1% TiC—Mo (Comparative Example) | 2200 | 30 | 1.5 | 240 | 300 |
| 3 | 0.2% TiC—Mo (Example) | 2200 | 20 | 3.8 | 260 | 400 |
| 4 | 0.3% TiC—Mo (Example) | 2200 | 20 | 4.3 | 270 | 450 |
| 5 | 0.5% TiC—Mo (Example) | 2200 | 30 | 4.5 | 280 | 530 |
| 6 | 0.8% TiC—Mo (Example) | 2200 | 20 | 4.5 | 300 | 550 |
| 7 | 1.0% TiC—Mo (Example) | 2200 | 20 | 4.5 | 320 | 550 |
| 8 | 1.5% TiC—Mo (Example) | 2200 | 30 | 4.5 | 340 | 560 |
| 9 | 2.0% TiC—Mo (Comparative Example) | 2200 | 30 | 4.5 | 370 | 560 (cracked) |
| 10 | 0.5% TiC—Mo (Comparative Example) | 1800 | 30 | 1.5 | 210 | 360 |
| 11 | 0.5% TiC—Mo (Comparative Example) | 2000 | 20 | 2.5 | 220 | 380 |
| 12 | 0.5% TiC—Mo (Comparative Example) | 2100 | 30 | 3.6 | 270 | 490 |
| 13 | 0.5% TiC—Mo (Example) | 2300 | 30 | 4.8 | 290 | 540 |
| 14 | 0.5% TiC—Mo (Vacuum sintering: Comparative Example) | 2200 | 300 | 2.0 | 230 | 400 |
| 15 | 0.8% TiC—Mo (Example) | 2200 | 30 | 10 | 320 | 550 |
| 16 | 0.8% TiC—Mo (Example) | 2200 | 20 | 15 | 330 | 550 |
| 17 | 1.0% TiC—Mo (Example) | 2200 | 30 | 18 | 330 | 560 |

TABLE 2

| Sample | Composition, wt % | Sintering temperature, ° C. | Amount of oxygen, ppm | Aspect ratio of carbide | Hardness, HV | Tensile strength, MPa |
|---|---|---|---|---|---|---|
| 18 | 0.1% HfC—Mo (Comparative Example) | 2400 | 30 | 1.5 | 240 | 300 |
| 19 | 0.2% HfC—Mo (Example) | 2400 | 20 | 3.8 | 260 | 400 |
| 20 | 0.3% HfC—Mo (Example) | 2400 | 20 | 4.3 | 270 | 450 |
| 21 | 0.5% HfC—Mo (Example) | 2400 | 30 | 4.5 | 280 | 530 |
| 22 | 0.8% HfC—Mo (Example) | 2400 | 20 | 4.5 | 300 | 550 |
| 23 | 1.0% HfC—Mo (Example) | 2400 | 20 | 4.5 | 320 | 550 |
| 24 | 1.5% HfC—Mo (Example) | 2400 | 30 | 4.5 | 340 | 560 |
| 25 | 2.0% HfC—Mo (Comparative Example) | 2400 | 30 | 4.5 | 370 | 560 (cracked) |
| 26 | 0.5% HfC—Mo (Comparative Example) | 1800 | 30 | 1.5 | 210 | 360 |
| 27 | 0.5% HfC—Mo (Comparative Example) | 2000 | 20 | 2.5 | 220 | 380 |
| 28 | 0.5% HfC—Mo (Example) | 2100 | 30 | 3.6 | 270 | 490 |
| 29 | 0.5% HfC—Mo (Example) | 2400 | 30 | 4.8 | 290 | 540 |
| 30 | 0.5% HfC—Mo (Vacuum sintering: Comparative Example) | 2200 | 300 | 2.0 | 230 | 400 |
| 31 | 0.8% HfC—Mo (Example) | 2400 | 20 | 10 | 270 | 530 |
| 32 | 0.8% HfC—Mo (Example) | 2400 | 20 | 15 | 280 | 520 |
| 33 | 1.0% HfC—Mo (Example) | 2400 | 20 | 18 | 270 | 500 |

TABLE 3

| Sample | Composition, wt % | Sintering temperature, ° C. | Amount of oxygen, ppm | Aspect ratio of carbide | Hardness, HV | Tensile strength, MPa |
|---|---|---|---|---|---|---|
| 34 | 0.1% ZrC—Mo (Comparative Example) | 2400 | 30 | 1.5 | 220 | 300 |
| 35 | 0.2% ZrC—Mo (Example) | 2400 | 20 | 3.8 | 260 | 400 |
| 36 | 0.3% ZrC—Mo (Example) | 2400 | 20 | 4.3 | 270 | 450 |
| 37 | 0.5% ZrC—Mo (Example) | 2400 | 30 | 4.5 | 280 | 530 |
| 38 | 0.8% ZrC—Mo (Example) | 2400 | 20 | 4.5 | 310 | 550 |
| 39 | 1.0% ZrC—Mo (Example) | 2400 | 20 | 4.5 | 330 | 550 |
| 40 | 1.5% ZrC—Mo (Example) | 2400 | 30 | 4.5 | 340 | 560 |

TABLE 3-continued

| Sample | Composition, wt % | Sintering temperature, ° C. | Amount of oxygen, ppm | Aspect ratio of carbide | Hardness, HV | Tensile strength, MPa |
|---|---|---|---|---|---|---|
| 41 | 2.0% ZrC—Mo (Comparative Example) | 2400 | 30 | 4.5 | 400 | 560 (cracked) |
| 42 | 0.5% ZrC—Mo (Comparative Example) | 1800 | 30 | 1.5 | 220 | 360 |
| 43 | 0.5% ZrC—Mo (Comparative Example) | 2000 | 20 | 2.5 | 230 | 380 |
| 44 | 0.5% ZrC—Mo (Example) | 2100 | 30 | 3.6 | 270 | 490 |
| 45 | 0.5% ZrC—Mo (Example) | 2400 | 30 | 4.8 | 280 | 540 |
| 46 | 0.5% ZrC—Mo (Vacuum sintering: Comparative Example) | 2200 | 300 | 2.0 | 230 | 400 |
| 47 | 0.5% ZrC—Mo (Example) | 2400 | 20 | 10 | 260 | 510 |
| 48 | 0.8% ZrC—Mo (Example) | 2400 | 20 | 15 | 310 | 520 |
| 49 | 1.0% ZrC—Mo (Example) | 2400 | 30 | 18 | 330 | 510 |
| 50 | 0.5% ZrC—Mo (Example) | 2200 | 20 | 15 | 310 | 520 |
| 51 | 0.5% ZrC—Mo (Example) | 2200 | 30 | 18 | 330 | 510 |
| 52 | 0.8% ZrC—Mo (Example) | 2200 | 30 | 18 | 320 | 500 |

TABLE 4

| Sample | Composition, wt % | Sintering temperature, ° C. | Amount of oxygen, ppm | Aspect ratio of carbide | Hardness, HV | Tensile strength, MPa |
|---|---|---|---|---|---|---|
| 53 | 0.1% TaC—Mo (Comparative Example) | 2200 | 30 | 1.5 | 230 | 300 |
| 54 | 0.2% TaC—Mo (Example) | 2200 | 20 | 3.8 | 270 | 400 |
| 55 | 0.3% TaC—Mo (Example) | 2200 | 20 | 4.3 | 280 | 450 |
| 56 | 0.5% TaC—Mo (Example) | 2200 | 30 | 4.5 | 290 | 530 |
| 57 | 0.8% TaC—Mo (Example) | 2200 | 20 | 4.5 | 310 | 550 |
| 58 | 1.0% TaC—Mo (Example) | 2200 | 20 | 4.5 | 320 | 550 |
| 59 | 1.5% TaC—Mo (Example) | 2200 | 30 | 4.5 | 340 | 560 |
| 60 | 2.0% TaC—Mo (Comparative Example) | 2200 | 30 | 4.5 | 400 | 560 (cracked) |
| 61 | 0.5% TaC—Mo (Comparative Example) | 1800 | 30 | 1.5 | 230 | 360 |
| 62 | 0.5% TaC—Mo (Comparative Example) | 2000 | 20 | 2.5 | 230 | 380 |
| 63 | 0.5% TaC—Mo (Example) | 2100 | 30 | 3.6 | 270 | 490 |
| 64 | 0.5% TaC—Mo (Example) | 2300 | 30 | 4.8 | 290 | 540 |
| 65 | 0.5% TaC—Mo (Vacuum sintering: Comparative Example) | 2200 | 300 | 2.0 | 220 | 400 |
| 66 | 0.5% TaC—Mo (Example) | 2200 | 20 | 10 | 260 | 510 |

As can be seen from Tables 1 to 4, when the requirements in the present invention were satisfied, the Vickers hardness and tensile strength were high and the properties were excellent.

Example 2 and Comparative Example 2

TiC having an average particle diameter of 1 μm and ZrC having an average particle diameter of 1 μm were added, in respective amounts of 0.5% and 0.07% (in terms of % by weight of titanium and zirconium), to and mixed with a molybdenum (Mo) powder having an average particle diameter of 4 μm in a ball mill to produce a molybdenum mixed powder. Subsequently, 3 wt % rhenium (Re)-tungsten (W) alloy powder and the above molybdenum mixed powder were placed in a stacked state in a mold followed by molding in the mold at a pressure of 300 MPa to produce a laminated molded product of Re—W and Mo alloy.

Subsequently, the molded product was placed in a carbon crucible and was subjected to a first sintering step in vacuo at 1600° C. and was then subjected to a second sintering step in an argon atmosphere at 2200° C. Thereafter, forging and the like were carried out to produce an X-ray tube rotary anode target of Example 2 having a diameter of 120 mm. The molybdenum alloy had a carbide aspect ratio of 3.6 and a Vickers hardness of 280.

For comparison, a target of Comparative Example 2 was produced in the same manner as in Example 2, except that the material was sintered in vacuo without placing in the carbon crucible.

A shaft (a rotating shaft) was mounted on targets of Example 2 and Comparative Example 2, and each of the assemblies was incorporated in an X-ray tube. For each of the X-ray tubes thus obtained, the number of times of discharge was evaluated in a period for which X rays (rotation speed 8000 rpm) are output 10000 times. The results are shown in Table 5.

TABLE 5

| Sample | X-ray tube | Number of times of discharge |
|---|---|---|
| 67 | Example 2 | 0 time |
| 68 | Comparative Example 2 | 5 times |

It was found that the Examples of the present invention reduced the number of times of discharge. The discharge phenomenon shows that the target has been cracked. Since the targets in the Examples of the present invention have a high hardness, satisfactory strength can be obtained even when the target is large and has a diameter of not less than 100 mm.

Example 3

At the outset, a base material (a sinter) formed of a molybdenum alloy (a second molybdenum alloy) having an oxygen content of 300 ppm and comprising a composite oxide of titanium and zirconium was produced.

TiC having an average particle diameter of 1 μm and ZrC having an average particle diameter of 1 μm were then added, in respective amounts of 0.5% and 0.08% (in terms of % by weight of titanium and zirconium), to and mixed with a molybdenum (Mo) powder having an average particle diameter of 4 μm in a ball mill to produce a first molybdenum mixed powder.

Subsequently, the first molybdenum mixed powder and 5 wt % rhenium (Re)-tungsten (W) alloy powder were stacked on the base material, and the assembly was molded in a mold at a pressure of 300 MPa to produce a laminated molded product of Re—W layer/first molybdenum alloy layer/second molybdenum alloy layer.

The molded product was then placed in a carbon crucible and was subjected to a first sintering step in vacuo at 1500° C. and was then subjected to a second sintering step in an argon atmosphere at 2250° C. Thereafter, forging and the like were carried out to produce an X-ray tube rotary anode target o Example 3 having a diameter of 140 mm. The molybdenum alloy had a carbide aspect ratio of 3.8 and a Vickers hardness of 290.

Next, a spray deposited film of a mixture composed of $TiO_2$ and $Al_2O_3$ having a predetermined composition was formed on the surface of the assembly in its part other than the Re—W layer. Thus, X-ray tube rotary anode targets of the Examples of the present invention were produced.

Further, for each target, gas release properties were investigated with a gas release measuring apparatus. In this apparatus, the temperature of the test product within a quartz bell jar can be raised to a predetermined temperature with a heating oven, and a change in degree of vacuum and the partial pressure of gas being evolved are measured with an ionization gage and Q-MAS. Specifically, each target is exposed to a high-temperature atmosphere within the quartz bell jar tube of 1100° C., and a change in total pressure of the whole vessel and a change in partial pressure of each gas component ($H_2$, CO, $CO_2$, $H_2O$, $N_2$, $O_2$, HC, Ar, and other rare gases) are measured. The measured values were expressed in Torr.CC. The larger the value, the larger the gas release amount and the higher the tendency toward a lowering in the degree of vacuum within the vessel. In other words, the gas release amount decreases under high temperature conditions with a decrease in the measured values. Here the total pressure and the level of partial pressure of CO gas which exhibited the largest release amount are described. The total pressure is defined as the sum of the partial pressures of the various release gases. The proportion of occurrence of gas release amount which poses any problem in the production of X-ray tubes was expressed as yield (%) in the X-ray tube step. The results are shown in Table 6. Further, an X-ray tube rotary anode target was produced using the first molybdenum alloy only (sample 79). The results are also shown in Table 6.

TABLE 6

| Sample | Spray deposited film, wt % | Yield of X-ray tube, % | Total pressure within tube, Torr. CC | CO-gas partial pressure, Torr. CC |
|---|---|---|---|---|
| 69 | 13% $TiO_2$—$Al_2O_3$ | 96 | 98.0 | 75.1 |
| 70 | 20% $TiO_2$—$Al_2O_3$ | 92 | 103.4 | 80.5 |
| 71 | 40% $TiO_2$—$Al_2O_3$ | 97 | 98.3 | 78.3 |
| 72 | 13% $TiO_2$—$Al_2O_3$ | 92 | 108.4 | 80.1 |
| 73 | 20% $TiO_2$—$Al_2O_3$ | 96 | 89.1 | 68.4 |
| 74 | 40% $TiO_2$—$Al_2O_3$ | 95 | 97.3 | 84.2 |
| 75 | 13% $TiO_2$—$Al_2O_3$ | 92 | 110.8 | 89.2 |
| 76 | 20% $TiO_2$—$Al_2O_3$ | 94 | 108.4 | 92.1 |
| 77 | 40% $TiO_2$—$Al_2O_3$ | 92 | 116.3 | 98.9 |
| 78 | None | 85 | 132.4 | 102.9 |
| 79 | 20% $TiO_2$—$Al_2O_3$ | 93 | 116.8 | 89.3 |

It was found that the provision of the spray deposited film can improve both the total pressure within the tube and the release amount of the CO gas to improve gas release properties, whereby the ultimate vacuum of the X-ray tube can be improved and the yield is improved.

Example 4

Next, an embodiment wherein a melting crucible is used will be described.

TiC having an average particle diameter of 1 μm and ZrC having an average particle diameter of 1 μm were added, in respective amounts of 0.5% and 0.07% (in terms of % by mass of titanium and zirconium), to and mixed with a molybdenum (Mo) powder having an average particle diameter of 3 μm in a ball mill. The mixture was molded by CIP molding at a pressure of 200 MPa into a crucible shape. Thereafter, the molded product was placed in a carbon crucible, was subjected to a first sintering step in vacuo at 1500° C., and was subjected to a second sintering step in a nitrogen atmosphere at 2100° C. to produce a melting crucible of Example 4.

For comparison, a crucible was produced in the same manner as described above, except that sintering was carried out in vacuo without placing of the molded product in a carbon crucible.

The shape of the crucible after sintering was 10 mm in wall thickness, 50 mm in height, and 100 mmϕ in outer diameter. Further, the molybdenum alloy of the Example of the present invention had a carbide aspect ratio of 3.6 and a Vickers hardness of 280, the comparative molybdenum alloy had a carbide aspect ratio of 1.3 and a Vickers hardness of 200.

The following test was carried out. Specifically, metallic yttrium was placed in each crucible and was melted at 1700° C. for 30 min, and the procedure was repeated to determine the number of times of repetition of the procedure necessary for forming a hole in the crucible. The results are shown in table 7.

TABLE 7

| Sample | Melting crucible | Number of times of use |
|---|---|---|
| 80 | Example 4 | 20 times |
| 81 | Comparative Example | 5 times |

As can be seen from Table 7, the melting crucible of the Example of the present invention had a prolonged service life.

Example 5

Next, sample 82 was provided which was the same as sample 5, except that 0.07% by weight of ZrC was further added. The same measurement as in sample 5 was carried out for sample 82. As a result, sample 82 had an oxygen content of 30 ppm, a carbide aspect ratio of 4.5, a hardness (HV) of 290, and a tensile strength of 540 MPa.

Further, for sample 5 and sample 82, the carbon content was measured. The results are shown in Table 8.

TABLE 8

| | Oxygen, wt % | Carbon, wt % | Titanium, wt % | Zirconium, wt % |
|---|---|---|---|---|
| Sample 5 | 0.003 | 0.075 | 0.49 | — |
| Sample 82 | 0.003 | 0.075 | 0.49 | 0.068 |

Further, for the samples, the elongation (%) at 1237K was also measured. The elongation was measured using a No. 4 specimen specified in JIS Z 2201 by a breaking elongation test specified in JIS Z 2241. The results are shown in Table 9.

TABLE 9

| | Elongation, % |
|---|---|
| Sample 5 | 14 |
| Sample 82 | 15 |

As can be seen from the table, sample 82 had an improved elongation over sample 5. This is considered attributable to the formation of a composite carbide as a result of addition of two types of carbides of TiC and ZrC. Further, the elongation of samples for each Example shown in Tables 1 to 4 was measured. As a result, for all the samples, the elongation fell within the range of 14 to 20%.

The invention claimed is:

1. An X-ray tube rotary anode target having a structure comprising a first molybdenum alloy and a second molybdenum alloy stacked on top of each other, wherein the first molybdenum alloy has an oxygen content of not more than 50 ppm and comprises 0.2 to 1.5% by weight of a carbide and the balance, molybdenum, the carbide being at least one selected from titanium carbide, hafnium carbide, zirconium carbide and tantalum carbide, and a part of the carbides has an aspect ratio of not less than 2, and the second molybdenum alloy has an oxygen content of 200 to 2000 ppm and comprises a composite oxide comprising titanium and zirconium.

2. The X-ray tube rotary anode target according to claim 1, wherein said target has a diameter of more than 100 mm.

3. The X-ray tube rotary anode target according to claim 1, wherein the first molybdenum alloy is used for the X-ray tube rotary anode target at a place to which a rotary shaft is joined.

4. The X-ray tube rotary anode target according to claim 1, wherein a metal or alloy layer formed of at least one metal selected from tungsten (W), molybdenum (Mo), niobium (Nb), tantalum (Ta), rhenium (Re), titanium (Ti), zirconium (Zr), and carbon (C) is provided on an electron beam irradiation face of the X-ray tube rotary anode target.

5. The X-ray tube rotary anode target according to claim 4, wherein an oxide film is provided on the surface of a part other than the electron beam irradiation face.

6. An X-ray tube comprising an X-ray tube rotary anode target according to claim 1.

7. The x-ray tube rotary anode target according to claim 1, wherein the aspect ratio is not less than 3.5.

8. The x-ray tube rotary anode target according to claim 1, wherein said alloy has a Vickers hardness of more than 250 HV and less than 350 HV.

* * * * *